United States Patent [19]

Cartesse

[11] Patent Number: 4,659,162

[45] Date of Patent: Apr. 21, 1987

[54] MULTIPLE CONTACT CONNECTOR CASING AND DEVICE FOR LOCKING CONTACT CARRIER IN CASING

[75] Inventor: Georges Cartesse, Le Blanc Mesnil, France

[73] Assignee: Societe Generale pour l'Industrie Electronique (S.O.G.I.E.), S.A., Rosny-Sous-Bois, France

[21] Appl. No.: 795,276

[22] Filed: Nov. 5, 1985

[30] Foreign Application Priority Data

Nov. 5, 1984 [FR] France ..... 84 16793

[51] Int. Cl.[4] ..... H01R 13/516

[52] U.S. Cl. ..... 339/128; 339/64 M; 339/59 M

[58] Field of Search ..... 339/128, 132 R, 132 B, 339/217 R, 65, 66 M, 64 R, 64 M, 92 M, 91 R

[56] References Cited

U.S. PATENT DOCUMENTS 3,671,921 6/1972 Baker et al. ..... 339/91 R X 3,951,514 4/1976 Medina ..... 339/64 M X

*Primary Examiner*—Eugene F. Desmond

*Attorney, Agent, or Firm*—Brisebois & Kruger

[57] ABSTRACT

An insulating contact carrier block is immobilized and locked in a corresponding cavity of an electrical connector casing by at least one, and preferably two elastic clips. The clips are disposed respectively between the ends of the contact carrier block and the respective ends of the cavity of the casing. Each clip is of U shape, has a center web for hooking the clip on the adjacent end wall of the casing cavity, and legs projecting in the same direction from the ends of the web, straddle and elastically engage the sides of the block. An elastic tab on the web engages the adjacent end of the insulating carrier block during insertion of the block into the cavity, and snaps over a stop shoulder on the block to lock the block in its seated position in the cavity. Free ends of the legs of the clip engage stepped shoulders on the cavity side walls to prevent unhooking of the web from the end wall of the cavity.

10 Claims, 7 Drawing Figures

MULTIPLE CONTACT CONNECTOR CASING AND DEVICE FOR LOCKING CONTACT CARRIER IN CASING

This invention relates generally to connector assemblies, and particularly to connector assemblies of the type in which an insulating multiple contact carrier block of rectangular profile is seated in and locked in a rectangular cavity or opening of a connector casing or shell.

More particularly, the invention relates to a unique locking arrangement, including an elastic clip, and cooperating elements of the insulating block and cavity of the casing for locking the insulating contact carrier block in the cavity.

BACKGROUND OF THE INVENTION

Insulating contact carrier blocks are at present secured in the cavity of a connector casing by a rear plate which covers the rear face of the contact carrier block. The rear plate is usually secured to the casing with fasteners such as screws, which are threaded into the rear wall of the casing.

The disadvantage of such a construction is the increase of depth of the connector assembly because of the rear plate and screws. Such increased depth presents problems in applications where space is very limited, and the plate and fasteners complicate assembly and disassembly when it is necessary to remove the carrier block to work on the contacts.

French patent application No. 83-000-18, of applicant's assignee, discloses a multiple contact connector having unique means for immobilizing and securing the insulating contact carrier in the connector casing.

SUMMARY OF THE INVENTION

The present invention provides a connector assembly which avoids the disadvantages of the prior constructions, and permits rapid assemble of the carrier block to the casing, and rapid removal of the block from the casing, to work on the contacts.

In accordance with the invention, each insulating block is immobilized and locked in a corresponding cavity of a casing by at least one, and preferably two elastic clips. When two clips are used these clips are disposed respectively between the ends of the contact carrier block and the respective ends of the cavity of the casing. Each of the clips is essentially of U shape, and has a center web, and legs projecting in the same direction from the ends of the web. The web has means for hooking the clip on the adjacent end wall of the casing cavity. Elastic means on the web engages the adjacent end of the insulating carrier block during insertion of the block into the cavity, and snaps over a stop shoulder on the block to lock the block in its seated working position in the cavity. Each of the legs of a clip includes elastic portions which engage against the adjacent side of the block to firmly hold the block and to resist lateral movement of the block in the cavity. The . legs of the clip have end edges adapted to engage stepped shoulders on the cavity side walls, which face toward the end walls and prevent unhooking of the web from the end wall of the cavity.

In one embodiment the hooking means on the web of the clip includes an opening, which can be rectangular to engage on a projection of like section on the end wall of the cavity.

The elastic means of the web of the clip which presses on the end wall of the block can take the form of an inwardly sloping tab with an end edge that engages behind the stop shoulder of the block to lock the block in its seated position.

The elastic portions of the legs of the clip which engage the sides of the block are located approximately at the midpoint of the length of the legs, and take the form of convex inwardly deformed portions.

Transverse slots in the legs enhance their resiliency to enable the ends of the legs to engage behind the clip-retaining shoulders on the side walls of the cavity. These slots are preferably formed on opposite sides of the convex inwardly deformed portions.

To make the invention better understood, a wholly non-limiting example of a preferred embodiment will now be described, with reference to the accompanying drawings.

DETAILED DESCRIPTION

Figure 1:
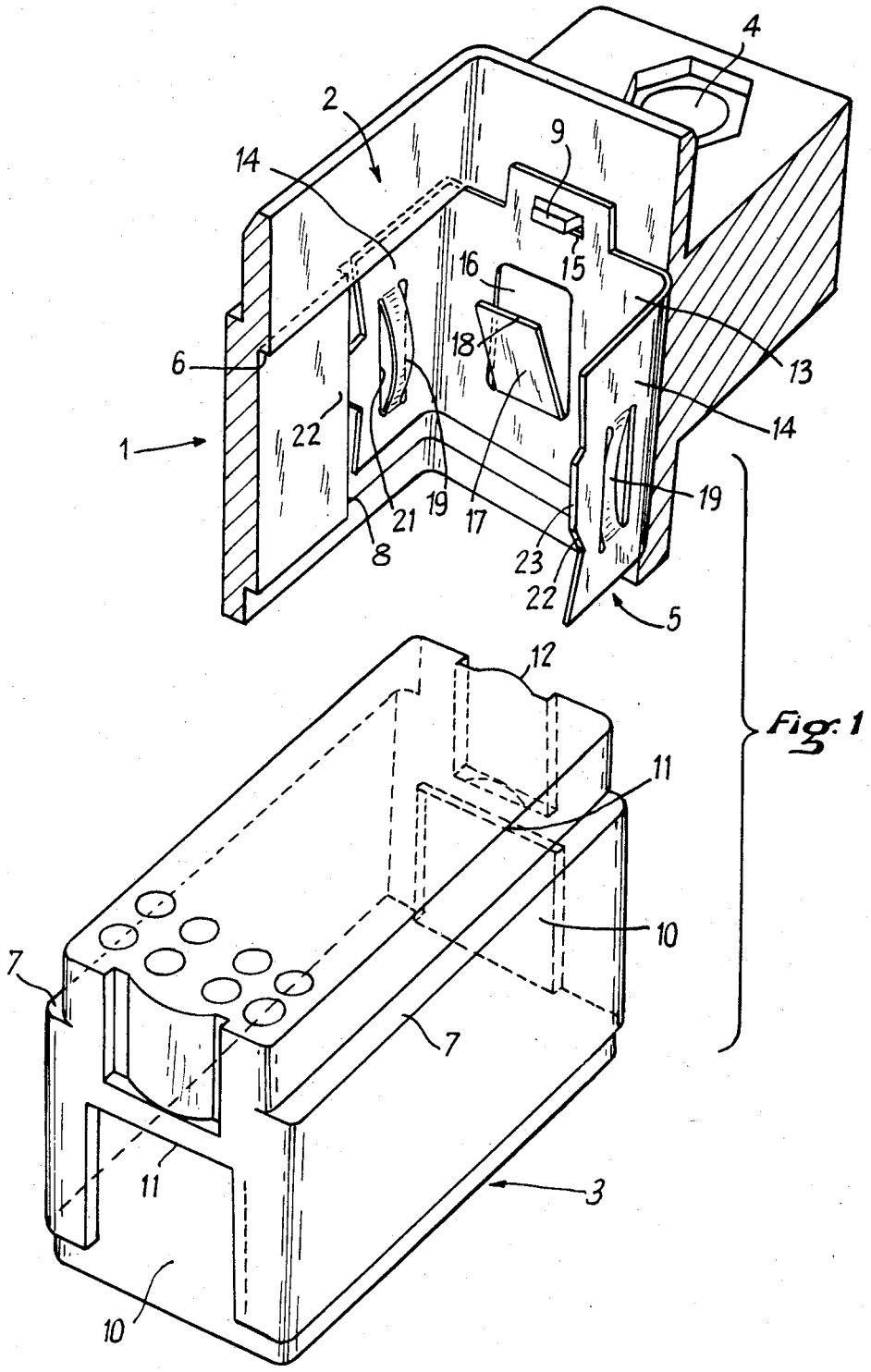
FIG. 1 is an exploded perspective view of a connector assembly according to the invention, with portions in section.
Figure 2:
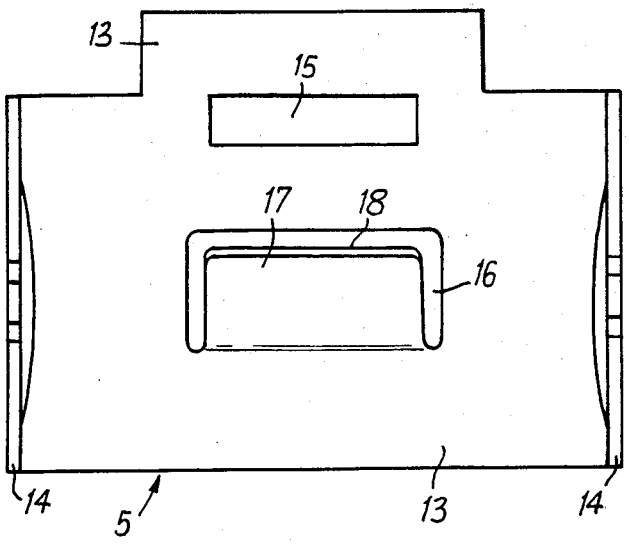
FIG. 2 is a front view in elevation of a locking clip, according to the invention, which is used in the connector assembly of FIG. 1.
Figure 4:
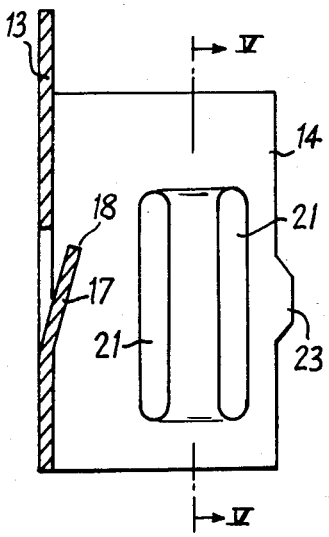
FIG. 4 is a side view in section of the locking clip of FIG. 2.
Figure 3:
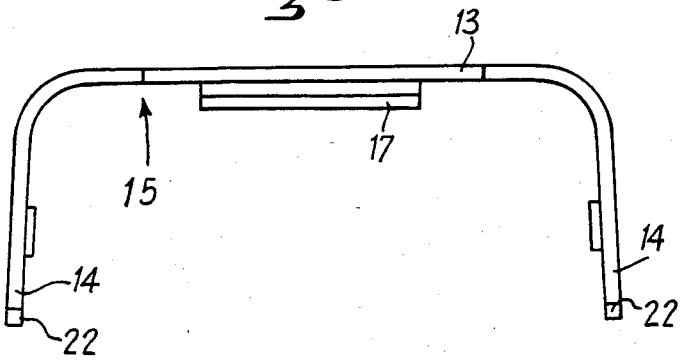
FIG. 3 is a top view of the locking clip of FIG. 2.

It will be seen from the drawings that the electrical multiple contact connector assembly, according to the invention, includes an elongated casing or shell 1 of essentially flat parallelipiped or rectangular profile, with rounded corners. As can best be seen at FIG. 6, casing 1 can have a plurality of cavities or openings, two of which are shown at FIG. 6, and in which are seated insulating blocks 3 and 3' respectively, each of which has a plurality of contact receiving sockets or cells to receive and retain electrical contacts which traverse the connector assembly.

An example of contacts which can be inserted in the sockets of the insulating block is found in published French Patent Application No. 2,344,978.

The connector casing 1 is preferably made of an alloy of a light weight metal such as AS 13 aluminum alloy, and has at its opposite ends, locking means 4, which can coact with mating locking means of a mating connector assembly. These locking means can for example take the form of a screw and threaded socket or a threaded stud and lock nut.

Figure 6:
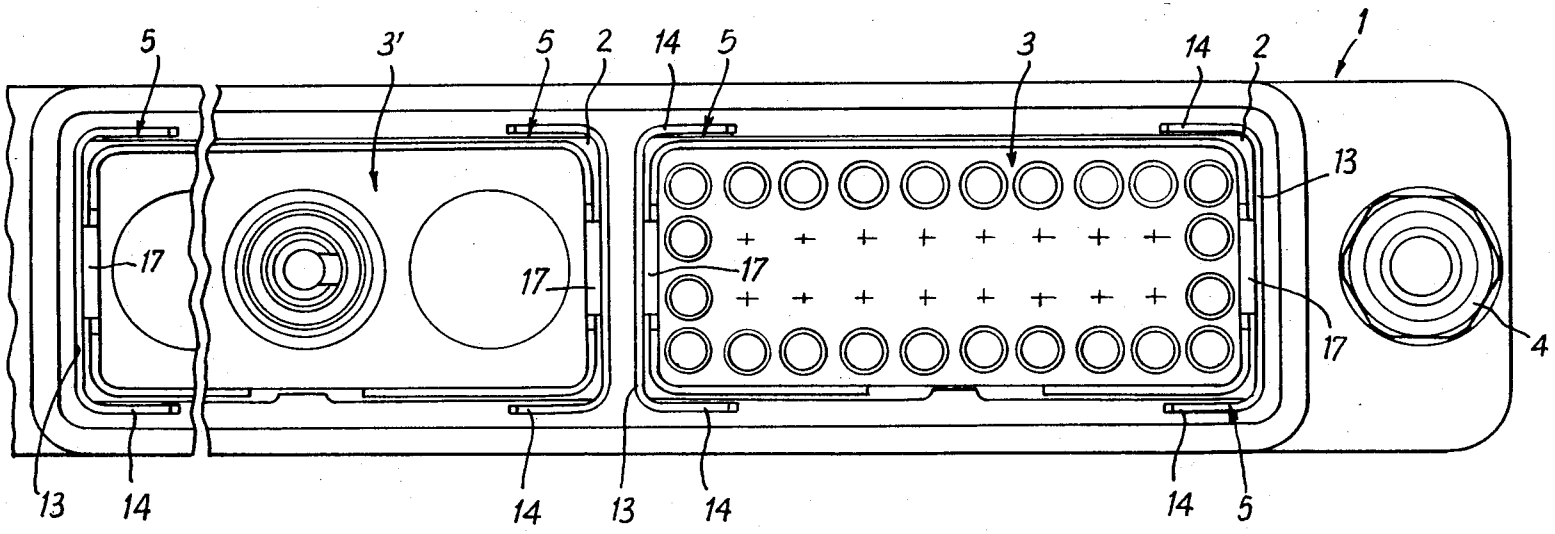
FIG. 6 is a rear view in elevation of an assembled connector assembly according to the invention.

Each insulating block 3 and 3' is, as best shown at FIG. 6, secured in a corresponding cavity 2 of the casing 1 by two locking elements in the form of clips 5 the details of which will soon be described.

FIG. 1 shows that casing 1 of the connector assembly has a support step or shoulder 6 in each side wall of cavity 2 which is parallel to the plane of the open front and rear of the cavity, and faces downwardly toward the rear of the casing, when the casing is oriented as shown at FIG. 1 The shoulders 6 provide abutment surfaces or stops for the forwardly facing elongated nartow support shoulders 7 at the opposite sides of insulating block 3.

Recesses are formed in the long side walls of the cavities of casing 1 to provide shoulders or steps 8 which are orthogonal to the shoulders 6. These recesses extend to the end walls of the cavities 3.

Inwardly projecting blocks or lugs 9 which can be rectangular in section, are provided on each end wall of a cavity 3. It can be seen at FIG. 1, that lug 9 is located on the end wall mid-way between the sides and is offset toward the front of the casing.

In each end wall of an insulating block 3 and 3', there is a generally rectangular recess 10 which opens toward the rear of the insulating block 3. This recess presents a locking shoulder or surface 11 which is parallel to and faces toward the rear surface of the insulating block.

Formed in each end of the insulating block is a recess with parallel side edges and a convex central portion which curves arcuately between the side edges. These convex surfaces curve about an axis transverse to the front and rear surfaces of the insulator block 3.

The locking clip 5 for securing the insulating block 3 in casing 1 will now be described with reference to FIGS. 1-5. As previously mentioned, in the preferred embodiment, two clips 5 are used to secure an insulating block 3 in a corresponding cavity 2 of the casing 1.

Clip 5 is essentially "U" shaped in section and is formed, for example, from copper-beryllium or stainless steel with spring characteristics.

Clip 5 has a central core or web 13 and two side legs 14 which diverge slightly with respect to each other in their relaxed state, and project from the opposite sides of the web 13.

Formed in web 13 is a rectangular cutout or opening 15 for engagement on the projecting block or lug 9 on the end wall of the cavity 3 of the casing, as shown at FIG. 1. Web 13 also has a cut 16 to define a locking tab 17 which is bent at its base to extend inwardly and at a small angle to the plane of web 13. An end edge 18 of tab 17 is arranged to seat against locking shoulder 11 of the insulating block to thus provide lock means for locking the insulating block in the cavity. When edge 18 engages behind shoulder 11, the insulating block is locked in the cavity against rearward withdrawal.

Figure 5:
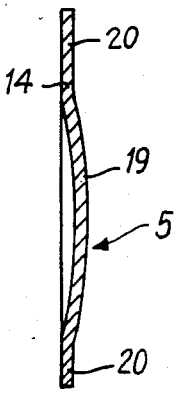
FIG. 5 is a view in section taken along line V—V of FIG. 4.

Each of the legs 14 of the clip 5 has an inwardly struck out curved central portion 19, which is best seen at FIGS. 1 and 5. The portion 19 is convex as viewed from a position between the legs 14. The legs 14 are otherwise essentially flat. Slots 21 are formed at opposite sides of these convex portions 19 to increase the elasticity of the free ends 22 of the legs. As a result of this elasticity of the legs 14, the end edges 23 can engage behind the shoulders 8 on the side walls of the cavities to retain the clip 5 so that dislodgement from the lug 9 is prevented.

To mount and lock an insulating block 3 in casing 2, two clips 5 are first inserted upwardly into the cavity 3 to the position shown at FIG. 1. Such positioning of the blocks is accomplished by squeezing the legs 14 inwardly in order to engage opening 5 over lug 9 and then moving the clip so that its web 14 is against the end wall of cavity 3. Then, when the legs 14 are released, they spring outwardly behind the shoulders 8 in the side wall of cavity 3.

When the clips 5 are so positioned, insulating block 3 is inserted from the rear toward the front of the cavity (upwardly, when casing 1 is in the position shown at FIG. 1), until the insulating block reaches a position in which the end edges 18 of tabs 17 of the clips engage under shoulders 11 of the recesses 10 at the opposite ends of the insulating block. The insulating block and the tabs 17 of the clips 5 are so dimensioned that the tabs 17 snap inwardly across the shoulders 11, when the surfaces 7 of the insulating block engage shoulders 6 of the cavity. The tabs 17 lock the insulating block against withdrawal and also provide slight end pressure on the ends of the insulating block so they tend to restrain the insulating block from endwise movement. In addition, the convex spring portions 19 engage the side faces of the insulating block (at four locations since the are two clips 5, one at each end of a cavity), to maintain the block generally centered between the side walls of the cavity. Such centering permits the use of greater dimensional tolerances for the forming of casing 1 and insulating block 3, and assures firmly maintaining the insulating block in a laterally centered position.

Figure 7:
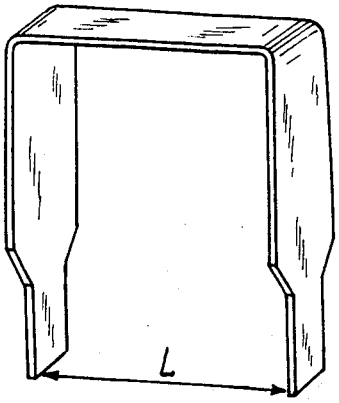
FIG. 7 is a perspective view of a tool for unlocking the insulating contact carrier block from the connector assembly of the invention.

An insulating block seated and locked in cavity 2 can be removed by using the tool shown at FIG. 7. This tool is of "U" shaped section and the distance L between its legs corresponds to the length of the insulating block between its ends. In use, the legs of the tool are inserted from the rear of the casing into the respective recesses 10 at the opposite ends of the insulating block so that the tabs 17 are forced outwardly as the tool is pushed inwardly. Advantageously, the thickness of each leg of the tool is slightly greater than the depth of the recess 10 so that each tab 17 is pushed outwardly beyond the respective shoulders 11 of the insulating block. With the tabs so retracted, the insulating block is pushed rearwardly toward the tool and can easily be removed.

Although a preferred embodiment of the invention has been shown and described, changes and variations can be made without departing from the scope or spirit of the invention.

I claim:

1. An electrical multiple contact connector assembly comprising, a casing having a rectangular cavity with opposed side walls and opposed end walls, a rectangular insulating block seated in said cavity, said insulating block having ends respectively adjacent said end walls of said cavity and sides respectively adjacent said side walls of the cavity, and means for securing said insulating block against withdrawal from said seated position in said cavity, said securing means comprising a first generally "U" shaped elastic clip and a second generally "U" shaped elastic clip, each clip having a central web and legs projecting from opposite ends of said web, said clips being disposed in said cavity, with said webs respectively between the end walls of the cavity and the ends of the insulating block, and with said legs respectively between the side walls of the casing and the sides of the insulating block, cooperating interlocking means on each web and each end wall of said cavity for retaining said clips in a predetermined position within said cavity, resilient means projecting inwardly from each web and engaging the adjacent end of the insulating block, resilient means on each of said legs and engaging adjacent sides of said block, and means for restraining each clip against endwise movement so that dislodgement of said clips from said respective cooperating means of the end walls is prevented.

2. A connector assembly according to claim 1 wherein said cooperating means between said webs and said end walls of said cavity comprises a projection on said end wall, and an opening in said web for receiving the projection therein.

3. A connector assembly according to claim 2 wherein said projection comprises a rectangular projection on said end wall, and said opening comprises a rectangular opening in said web.

4. A connector assembly according to claim 1 wherein each leg of a clip has at least one elongated slot generally parallel to the web to increase the resiliency of the leg.

5. A connector assembly according to claim 1 wherein said resilient means projecting inwardly from each web comprises, a tab bent to project inwardly from the web and which engages the adjacent end surface of the insulating block so that said tabs cooperate to longitudinally center the insulating block in the cavity, a locking shoulder at each end of the insulating block, each tab having an end edge which snaps behind the locking shoulder of the adjacent end of the block upon insertion of the insulating block into the cavity to said seated position, to lock the insulating block in the cavity of the casing.

6. A connector assembly according to claim 1 wherein said cavity of said casing further comprises opposed recesses in said side walls for receiving the legs of the clip therein, said recesses each having a shoulder facing toward the adjacent end wall, said legs having free ends engaging the respective shoulders to secure the clip against dislodgement from said projection.

7. A connector assembly according to claim 1 wherein said resilient means on each of said legs comprise, inwardly projecting curved portions for engagement with the sides of the insulating block to restrain said insulating block against lateral movement.

8. A connector assembly according to claim 7 wherein said inwardly projecting curved portions join flat portions of the legs at the ends of the curved portions, said flat portions engaging the side walls of the cavity of the casing.

9. A connector assembly according to claim 7 wherein said inwardly projecting curved portions each comprise curved portions having cuts at each side separating the sides of the curved portions from the legs.

10. A device for immobilizing a rectangular insulating block having ends and sides and seated in a casing, of an electrical multiple contact connector, having a rectangular cavity with opposed side walls and opposed end walls, said device comprising, at least one generally "U" shaped elastic clip having a central web and legs projecting from opposite ends of said web, said clip being adapted to be disposed in the cavity, with said web between an end wall of the cavity and an end of the insulating block, and with said legs respectively between the side walls of the casing and the sides of the insulating block, said web having means for hooking onto cooperating means of an end wall of the cavity, resilient means projecting inwardly from said web for engaging an adjacent end of the insulating block, and resilient means on each of said legs for engaging adjacent sides of the block, each of the legs of the clip having free ends adapted to engage a facing shoulder of the cavity for restraining the clip against endwise movement so that dislodgement of said clip from the cooperating means of the end wall of the cavity is prevented.

* * * * *